US008020494B2

(12) United States Patent
Smith et al.

(10) Patent No.: US 8,020,494 B2
(45) Date of Patent: Sep. 20, 2011

(54) ANTI-ROLL BACK ASSEMBLY WITH LINEAR MAGNETIC POSITIONING

(75) Inventors: John Douglas Smith, Orlando, FL (US); Katherine Kelly, Windermere, FL (US); L. Keith Forbis, Yalaha, FL (US)

(73) Assignee: Disney Enterprises, Inc., Burbank, CA (US)

( * ) Notice: Subject to any disclaimer, the term of this patent is extended or adjusted under 35 U.S.C. 154(b) by 12 days.

(21) Appl. No.: 12/622,777

(22) Filed: Nov. 20, 2009

(65) Prior Publication Data

US 2011/0120340 A1 May 26, 2011

(51) Int. Cl.
*B61K 7/00* (2006.01)

(52) U.S. Cl. ..... 104/250; 104/249; 104/252; 188/82.1

(58) Field of Classification Search ..... 104/250, 104/249, 252, 3, 118, 251, 292, 283; 188/82.1, 188/82.3, 82.4, 82.77, 82.8
See application file for complete search history.

(56) References Cited

U.S. PATENT DOCUMENTS

| | | | | |
|---|---|---|---|---|
| 5,325,790 | A | 7/1994 | Drayer | |
| 5,628,690 | A | 5/1997 | Spieldiener et al. | |
| 5,715,756 | A * | 2/1998 | Weigand et al. | 104/250 |
| 5,738,017 | A | 4/1998 | Behringer | |
| 5,947,030 | A * | 9/1999 | Spieldiener et al. | 104/250 |
| 6,062,350 | A | 5/2000 | Spieldiener et al. | |
| 6,293,376 | B1 | 9/2001 | Pribonic | |
| 6,412,611 | B1 | 7/2002 | Pribonic | |
| 6,523,650 | B1 | 2/2003 | Pribonic et al. | |
| 6,533,083 | B1 | 3/2003 | Pribonic et al. | |
| 6,659,237 | B1 * | 12/2003 | Pribonic | 188/165 |
| 6,918,469 | B1 | 7/2005 | Pribonic et al. | |
| 6,930,413 | B2 | 8/2005 | Marzano | |
| 2009/0031914 | A1 | 2/2009 | Hahn et al. | |

FOREIGN PATENT DOCUMENTS

| | | | |
|---|---|---|---|
| DE | 2536653 | A1 | 2/1977 |
| DE | 2540547 | A1 | 3/1977 |
| DE | 9418497 | U1 | 1/1995 |
| DE | 19525845 | C1 | 6/1996 |
| DE | 19744342 | A1 | 4/1999 |
| EP | 0575702 | A1 | 3/1993 |
| WO | 9318829 | A1 | 9/1993 |

OTHER PUBLICATIONS

Extended European search report; EP10189139, dated Mar. 3, 2011, from the European Patent Office.

* cited by examiner

*Primary Examiner* — Mark Le
(74) *Attorney, Agent, or Firm* — Marsh Fischmann & Breyfogle LLP; Kent A. Lembke

(57) ABSTRACT

An anti-roll back (ARB) assembly for use with vehicles that ride on a track, which has inclined portions that include a set of ARB or lift pins. The assembly includes a linear magnet assembly positioned along the track in the ARB portion, and this assembly includes spaced apart magnet arrays that define a slot or elongated magnetic force zone. The ARB assembly includes an ARB element with a body pivotally supported on a vehicle frame and further includes an electrically conductive reaction plate supported on the vehicle frame, and the plate passes through the magnet assembly slot when the vehicle travels on the track. The reaction plate is connected to the ARB body to pivot it in response to displacement of the reaction plate in response to magnetic forces to rotate it up into a suspended position in which the ARB body is spaced apart from the ARB pins.

20 Claims, 6 Drawing Sheets

ANTI-ROLL BACK ASSEMBLY WITH LINEAR MAGNETIC POSITIONING

BACKGROUND OF THE INVENTION

1. Field of the Invention.

The present invention relates, in general, to amusement park rides and other implementations in which it is desirable to prevent or control backward rolling of a car or vehicle, and, more particularly, to an anti-roll back assembly for use in such park rides or other implementations that functions to automatically position the anti-roll back (ARB) in a raised or normal operations position in which it is spaced apart from roll back pins or stops while the vehicle or car travels in a desired (or forward) direction and then to automatically position the ARB in a lowered or down position in which it engages a roll back pin or stop (or cross bolt/rail/chain) such that backwards/reverse roll or travel is stopped (or such that a vehicle may engage a chain/pin to be lifted up an inclined portion of the ride's or other implementation's track).

2. Relevant Background.

Many amusement or theme park ride attractions have vehicles or cars for carrying passengers, and a vehicle or car in a ride may be towed up an incline to a high elevation and released to continue throughout the ride path via gravity. The vehicle may be, for example, a roller coaster type car, or a water flume type boat in which the vehicles are pulled up the incline by a moving chain or cable. As a safety precaution, these types of ride attractions uniformly have braking or anti-roll back (ARB) systems to prevent a vehicle from moving in reverse down the incline. The ARB acts to prevent backward or reverse rolling in case the vehicle inadvertently is released from the towing chain or cable before reaching the crest of the incline or if the chain or drive system fails. In other words, an ARB is a unit traditionally found on coasters and similar rides that has two main purposes. The first is to engage with a chain to move a vehicle up a lift or inclined portion of the track. The second is to prevent the vehicle from moving backwards on a lift or inclined portion of the track in case of chain failure.

A common braking or ARB system in these applications uses a pivoting pawl on the bottom of the vehicle. As the vehicle is towed forwardly and upwardly on the incline, the pawl bumps over closely spaced apart stops. If the vehicle begins to move in reverse, the pawl engages the nearest downhill stop, thereby preventing any further reverse movement of the vehicle. As the stops are closely spaced apart, in the event of failure of the towing system, the vehicle can move only a very short distance in reverse such as only a few inches. This type of ARB system accordingly reliably prevents the vehicle from moving down the incline uncontrolled at high speed, potentially colliding with another vehicle. Presently, ARBs or the pawls of ARBs are pulled down (or actuated) by gravity, and the pawls are pivotally hung or supported on pins on the underside of the vehicle or car chassis or frame.

While these ARB systems using a pawl and a series of stops are widely used, they have a number of drawbacks. The vehicles often are traveling at high speeds over the ARB or stop sections of the track (e.g., up inclines that include the stops or ARB pins). The ARBs or ARB pawls are pulled toward the stops/pins by gravity and their front or leading edge contacts all or nearly all of the stops or pins, which produces the clank, clank, clank noise as the vehicle moves along the track. Hence, rides using the conventional, gravity actuated ARBs tend to be very noisy, generating loud clanking sounds, as the metallic pawl bumps over each of the fixed stops. Each impact of the pawl also generates shock and vibration in the vehicle and wear on the pawls and the stops.

Accordingly, a quieter ARB or braking system is desired to reduce noise pollution and preferably such an ARB system could be designed so as to also reduce wear and limit maintenance requirements. Some efforts have been made to provide an ARB that is suspended above the stops or ARB pins while the vehicle is traveling in a forward or desired direction such as up a lift. For example, some rides have been developed that suspend ARBs while the vehicle is traveling up a lift. One design makes use of a magnetic coupler in which a magnet is carried on the vehicle and a secondary wheel rides along a track. When the wheel is engaged the magnetic coupler rotates the ARB upward away from the stops/pins. These designs, however, have typically been limited to use when the vehicle is traveling at very low speeds (such as less than several feet per second) and tend to overheat at higher speeds experienced in normal operations of a coaster or similar vehicle (e.g., a coaster vehicle may travel up inclines at up to 30 feet per second or more).

Other designs have typically utilized mechanical assemblies such as ones with a secondary wheel and linkage that make use of friction or other forces to selectively lift the ARBs. These designs, however, have not been widely adopted because they require significant amounts of maintenance including daily adjustments by ride operators to obtain desired amounts of component interaction or frictional drag for proper operation/lift of the ARBs. Further, these types of drag-based ARB systems often are not useful for rides with higher vehicles speeds that are found in most coaster rides.

SUMMARY OF THE INVENTION

The present invention addresses the above and other problems by providing an anti-roll back (ARB) assembly with an ARB pawl or body attached to a vehicle to be positioned in an up or suspended position to be spaced apart from ARB pins (or stops). The suspended position is provided by the ARB assembly automatically as the vehicle travels in a forward or normal operating direct over a range of vehicle speeds, e.g., from low speeds (several feet per second) to very high speeds (up to 30 feet per second or faster). The ARB assembly, thus, prevents unwanted impacts of the ARB pawl on the racks of ARB pins to reduce wear and tear and to also limit noise pollution. The ARB assembly also functions to drop the ARB pawl or body into a down or lowered position to prevent/limit backwards motion of a vehicle or train (e.g., to engage the ARB pins/stops of a rack) and/or to engage a chain or other lift in an inclined portion of a track.

Briefly, the ARB assembly makes use of a linear magnetic brake (or eddy current) assembly to propel or force the ARB pawl or body to rotate about a mounting pin/axle provided on the vehicle chassis or frame to the up or suspended position. In some embodiments, an electrically conductive reaction plate or fin is provided in the ARB assembly and is mechanically mounted or linked to the ARB body. The plate is mounted to the vehicle (or within the ARB assembly) for translational and/or rotational movement and is linked or attached to the ARB body such that the ARB body rotates with the reaction plate. A linear magnet or eddy current assembly is mounted to or near the ride track in the areas of interest (e.g., the ARB portions of the track that may be in the inclined portions where roll back may be a concern). A gap or slot would be provided between permanent magnets having opposite polarity, and the ARB reaction plate would be provided on the vehicle so as to protrude outward from the vehicle and extend into (or at least proximate) to this gap or slot typically without contacting either of the paired magnets in the linear magnet assembly.

During operation of the ride, when the vehicle enters the ARB portion of the track, the reaction plate would be moved through the slot/gap and the permanent magnet field in or near this slot/gap, which would create a force on the plate opposite the direction of travel of the vehicle along the track. The force on the reaction plate would cause the plate to move opposite to the direction of travel (e.g., to rotate or to move in a translation/linear manner), and the movement of the plate would in turn cause the interconnected or linked ARB body or pawl to rotate to the up or suspended position. The ARB body or pawl is maintained in the up or suspended position as long as there is adequate relative velocity between the reaction plate and the permanent magnets in the linear magnet or eddy current assembly (e.g., the vehicle is moving at some minimum speed which may be as low as 1 to 5 feet per second).

When the vehicle stops, no force is applied on the plate. When the vehicle moves backwards at some minimum speed, a force is applied on the reaction plate by the linear magnet assembly that is again in the direction opposite the direction of travel, which forces or propels the plate to move (rotationally or translationally) so as to rotate the ARB body or pawl in the opposite direction or into the down or actuated position so as to engage ARB pins or stops (or a lift chain). When the vehicle exits the ARB portion of the track in which the linear magnet assembly is provided, the reaction plate is automatically returned (such as by gravity and/or a spring/resilient return member) to a neutral or normal operating position which allows or causes interconnected ARB pawl or body to drop down.

More particularly, an anti-roll back (ARB) assembly is provided for use with vehicles that ride on a track, such as passenger vehicles of a coaster ride that has a number of ARB portions (e.g., inclined portions of the track) that include a rack or set of ARB/lift pins. The assembly includes a linear magnet assembly (or eddy current assembly) that is positioned along the track in the ARB portion. The linear magnet assembly includes a pair of spaced apart magnet arrays that define a slot (or elongated magnetic force zone) that extends the length of the assembly or at least along the magnet arrays. The ARB assembly also includes an ARB element with a body that is pivotally supported on a frame of a vehicle. The ARB assembly further includes an electrically conductive reaction plate that is supported by the vehicle frame such that it protrudes outward to pass through the slot or magnetic force zone in the linear magnet assembly when the vehicle travels on the track over or near the ARB portion of the ride/track. The reaction plate is connected or linked to the ARB element such that the ARB body pivots in response to movement or displacement of the reaction plate, which results in the ARB body being positioned relative to the frame (e.g., between a down or normal operating position in which the ARB body may contact the ARB pins and an up or suspended position in which the ARB body is spaced apart from the ARB pins).

The reaction plate may take many forms to practice the ARB concepts described herein. In one embodiment, though, it may be useful to have the reaction plate have a ratio of volume to area of between about 0.35 and about 0.5 (with such ratio equal to volume of fin divided by area of fin). In some cases, the reaction plate or its body may take the form of a prismatic sector or have a prismatic sector shape to enhance ARC operations (or the fin may be considered a trapezoidal prism).

DETAILED DESCRIPTION OF THE PREFERRED EMBODIMENTS

Figure 1:
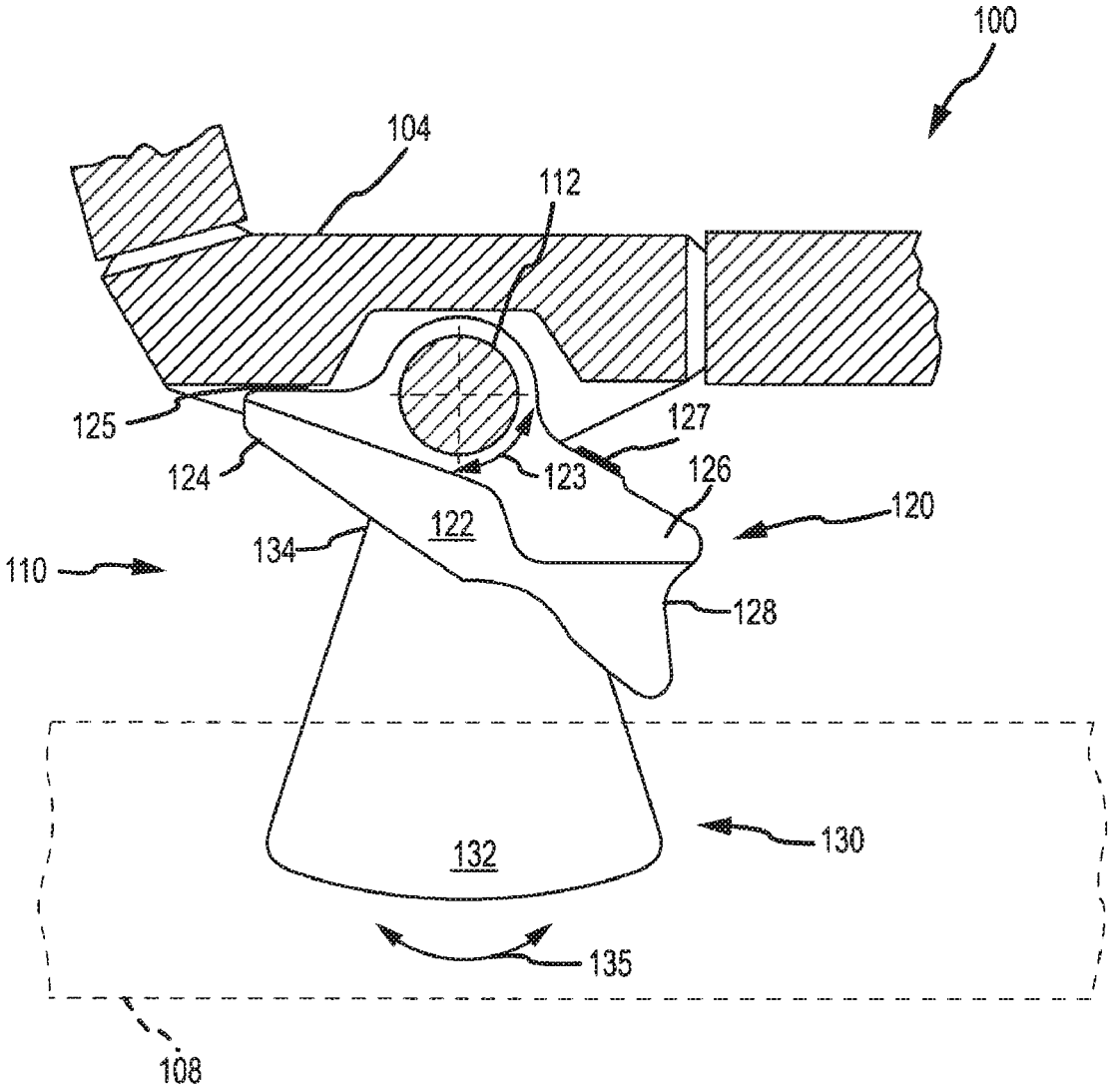
FIG. 1 shows a partial sectional view of a tracked vehicle system (such as an amusement or theme park ride) illustrating an embodiment of an anti-roll back (ARB) assembly in a down or normal operating position.

The following description is generally directed toward a silent one-way clutch design that is useful for providing an anti-roll back (ARB) assembly. The ARB assembly may be used within a variety of machines such as tracked vehicles that are used in amusement park or theme park rides and other applications in which it is desirable to provide lift of a vehicle in inclined portions of the track and also a safety mechanism to prevent backwards roll or travel (e.g., stop motion in an unintended direction). The ARB assembly described below is adapted to reduce wear and tear by suspending an ARB body or pawl above stops or lift/ARB pins when the vehicle carrying the ARB assembly travels in a first or forward direction while automatically lowering or dropping the ARB body or pawl when the vehicle stops and/or travels in a second or backward direction on the track.

The ARB assembly generally includes an ARB positioning or mounting assembly that includes a pivot pin supported on the bottom of the vehicle chassis/frame and an ARB pawl or body pivotally supported upon the pivot pin. The ARB positioning assembly further includes a reaction plate or fin that is interconnected with the ARB body such that when the reaction plate is moved (e.g., rotational or translational displacement) the ARB body is caused to rotate on the pivot pin from a normal operating or down position to a suspended or up position. In this down position, the ARB body will engage a lift chain or mechanism on the track and/or will engage ARB stops or pins, but, in the up position, the ARB body will be spaced apart from such lift/stop devices to reduce wear and noise during operation of the ride or other machine using the ARB assembly to selectively and automatically position the ARB body/pawl relative to lift and/or stop components.

The ARB assembly further includes a linear magnet assembly (or eddy current assembly) along the track in the ARB portions of the track (where lift/stop components such as ARB rails or pins are provided). The reaction plate is formed of a non-magnetic, electrically conductive material (or at least includes a layer/component of such material) and is positioned on the vehicle within the ARB positioning assembly so as to protrude outward (e.g., downward) from the vehicle chassis or frame and to pass between a gap, slot, or channel formed between the arrays of permanent magnets of the linear magnet assembly. A magnetic force is generated when the plate travels through the linear magnet assembly that is applied in a direction opposite the direction of travel of the vehicle.

The ARB positioning assembly is configured such that the reaction plate is moved or displaced when the vehicle travels through the linear magnet assembly in a first or forward direction and such plate movement or displacement is translated via a linkage or connection of the plate to the ARB body so as to cause the ARB body to rotate into the suspended or up position. However, when the vehicle travels in the second or backwards direction, the magnetic force is in the opposite direction (again, opposite to the direction of the vehicle travel along the track), and this causes the reaction plate to be displaced in the other direction causing the interconnected or linked ARB body to rotate into the lowered or down position in which the ARB body may engage a lift/stop pin or other lift/stop mechanism. The ARB positioning assembly further may be adapted such that, when the vehicle moves out of the area of interest or ARB portion of the track and the plate is not passing through a gap or slot in a linear magnet assembly, the ARB body is forced to or allowed to (via gravity actuation) rotate into a neutral or normal position (or down position), which may be the same as the lowered or down position or be a position between the suspended and lowered/down positions.

More particularly, FIG. 1 illustrates a portion a tracked vehicle system 100 that includes an ARB assembly 110 of one exemplary embodiment of the invention. As shown in simplistic fashion, a vehicle may be traveling on wheels on a track 108 (which is shown ghosted to more clearly show the ARB assembly 110). The ARB assembly 110 is mounted to the underside of the vehicle chassis or frame 104. The ARB assembly 110 is shown in a lowered or down position (which in this case matched the neutral or normal operating position), which may be useful or desirable when the vehicle 104 is traveling along non-ARB portions such as decline portions or flat portions of the track 108 and when contact with lift/stop components of the ride system 100 are not a concern.

As shown, the ARB assembly 110 includes an ARB positioning/mounting assembly 120 that includes a pivot pin or axle 112 that is supported on or by the vehicle frame 104, and the pin 112 may be supported on bearings or the like so as to pivot on the frame 104 as is shown at 123. Generally, the pin 112 may be arranged with its longitudinal axis extending transverse or even perpendicular to the track 108 (or direction of travel of the vehicle 104 on the track 108). The ARB positioning assembly 120 further includes an ARB body 122 that is rigidly affixed to the pin or rod 112 so as to pivot 123 with the pin 112. In other embodiments, the pin may be affixed to the chassis and the ARB body may rotate about the pin. In other words, the reaction plate may be affixed to the rotating pin or to the rotating ARB.

The ARB body 122 includes a front or leading end 124 with a bump stop 125 (e.g., a shock/wear absorbing component that may be formed as a rubber, plastic, or other material pad) that abuts the vehicle frame 104 when the ARB positioning assembly 120 is positioned into the lowered or down position as shown. The ARB body 122 also includes a trailing or pawl end 126 that includes a receiving/contact surface 128 for engaging lift/ARB pins (such as pins 290 shown in FIG. 2) when the vehicle is lifted up an inclined portion of track 108 or is stopped from backwards travel along track 108 (e.g., to the right in FIGS. 1 and 2). The body 122 also includes a bump stop 127 that may be configured similar to bump stop 125 to absorb shock when the body 122 is moved into a suspended or up position as shown in FIG. 2 to contact the frame 104.

Figure 2:
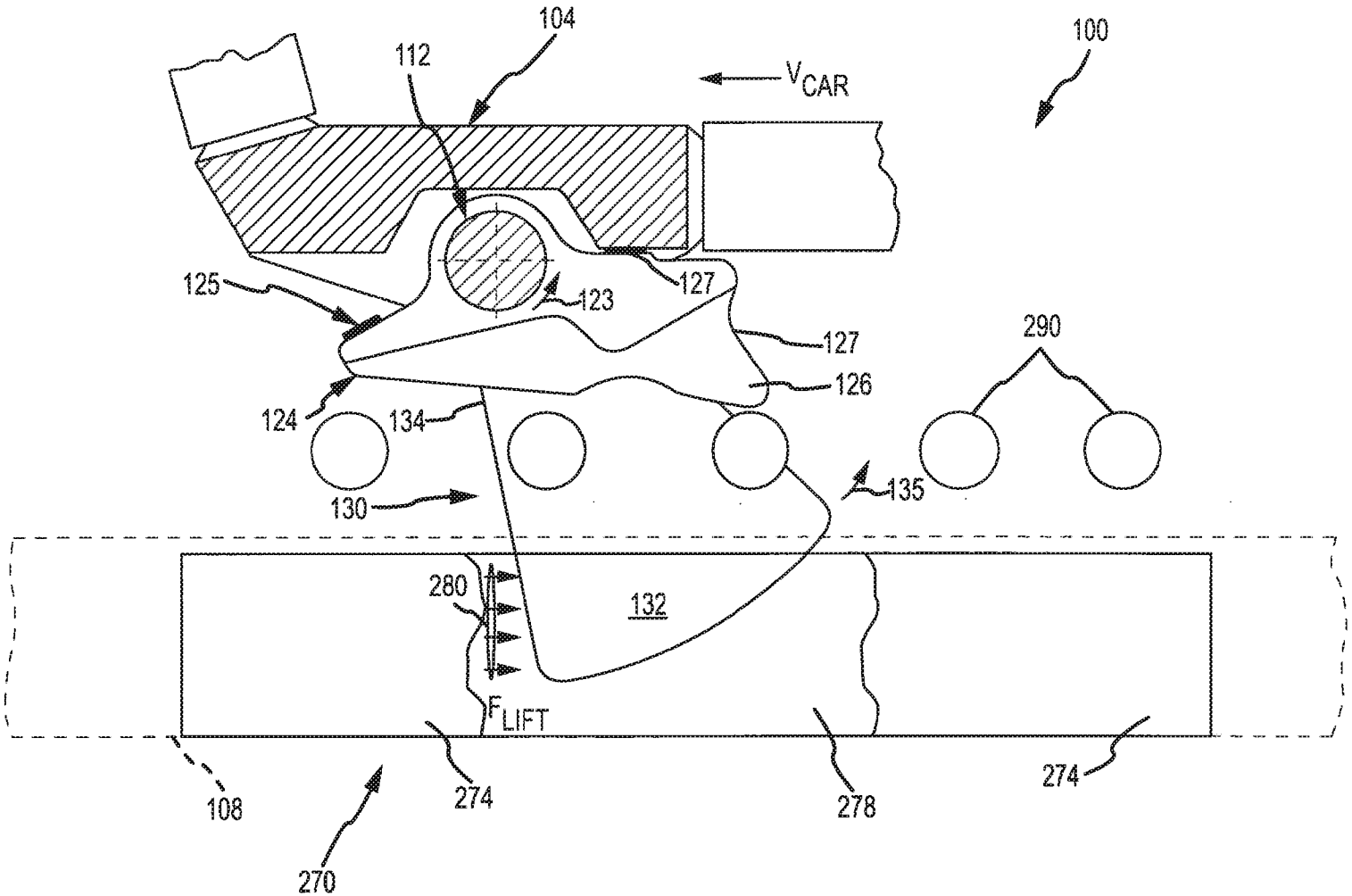
FIG. 2 shows the system of FIG. 1 in an ARB portion of the track illustrating use or operation of a linear magnet (or eddy current) assembly to rotate an ARB body or pawl via a reaction plate up into a suspended position to avoid contact with a set of ARB pins or stops.

The ARB positioning assembly 120 also includes a reaction plate or fin 130 that is interconnected with the body 122 to move or position the body 122 between the down position shown in FIG. 1 and the up or suspended position shown in FIG. 2. To this end, the reaction plate 130 is rigidly attached to the pivot pin or rod 112 at an upper or first end 134 and protrudes outward from the vehicle frame 104 to a lower/distal or second end 132. The second or lower end 132 may protrude between the rails of the track 108 (and between the paired magnets 274, 278 of a linear magnet assembly 270 shown in FIG. 2) and may rotate as shown at 135 as the frame 104 moves along the track 108. The rotation or displacement 135 causes the pin 112 to rotate 123 in a like direction so as to also rotate or position the interconnected body 122.

The reaction plate 130 is formed to provide an electrically conductive member as explained below, and it may take many shapes or forms to practice the invention. In this example 100, the plate 130 is a planar component that has a wider second or lower end 132 relative to the first or upper end 134 so as to generally take the shape of a propeller blade. This shape is useful for providing a reactive volume when passing through the eddy current assembly 270. Such a shape also provides weight in end 132 (e.g., a lower center of gravity is provided) to allow gravity to actuate 135 the positioning assembly 120 as shown in FIG. 1 to move the ARB body 122 into the down or lowered position whenever the magnetic field is removed (or when the magnetic force is in the left direction or opposite reverse travel of the frame 104).

FIG. 2 illustrates operation of the system 100 when the frame 104 is moved relative to the track 108 at a velocity, $V_{car}$, that is greater than some minimum speed (e.g., 1 to 5 feet per second or the like) that is useful for generating a motive or lifting force 280 great enough to rotate the reaction blade 130 as shown. The system 100 includes a plurality of lift/ARB pins 290 in or along this section of the track 108 (e.g., an ARB portion of the track 108) that are used to lift and/or stop the vehicle frame 104 from moving in an undesired direction (such as to the right in FIG. 2 which may coincided with rolling backwards down a lift/inclined portion). Since the vehicle 104 is traveling as shown by $V_{car}$ in a desired direction, the ARB positioning assembly 110 acts to suspend or lift the trailing or pawl end 126 of the ARB body 122 above or to a spaced apart location relative to the pins or stops 290. In the up or suspended position as shown in FIG. 2, the bump stop 127 contacts the frame 104 when the body 122 is pivoted upward with rotation 123 of the pivot pin 112.

To obtain the rotation 123, the reaction plate 130 is forced to rotate 135 via a lifting or positioning force 280 that is generated in response to the relative motion of the plate 130 through a gap or slot of a linear magnet assembly 270. The system 100 may include one or more linear magnet assemblies 270 in various ARB portions of the track 108 to position the reaction plate 130 in the up or suspended position shown in FIG. 2 or in the down/lowered position shown in FIG. 1 when travel occurs in the opposite or undesired direction (backwards roll or the like). As shown with the cutaway in FIG. 2, the linear magnet assembly 270 includes a first or nearside magnet (or array of magnets) 274 and a second or far side magnet (or array of magnets) 278. The magnets 274, 278 are arranged along the length of the track 108 so as to define an elongate slot or gap or channel through which the plate 130 or its end 132 may travel and extend (at least partially) such that a magnetic force 280 is generated in response to the relative velocity ($V_{car}$) of the plate 130 to the magnets 274, 278.

The force 280 acts as shown to cause the plate 130 to rotate 135, which causes the connected pin 112 to rotate 123 so as to rotate or lift the pawl end 126 of the ARB body 122 to cause the bump stop 127 to abut the frame 104. Hence, the force 280 is selected to be at least of enough magnitude to overcome or lift the weight of the plate 130 and body 122 and other factors such resistance (friction) to rotation of pin 112 on frame 104. When the vehicle frame 104 slows below a minimum speed or stops gravity may cause the plate 130 to rotate back towards the down or lowered position so as to position the body 122 (which is interconnected via the pin 112 with the plate 130) as shown in FIG. 1. This movement may be hastened by a magnetic force provided by the linear magnet assembly 270 as the undesired or backwards movement increases in speed, in the opposite direction of travel of the frame 104 so as to cause the plate 130 to move opposite the rotation shown at 135. As mentioned above, though, in other embodiments, the pin may be affixed to the chassis and the ARB body may rotate about the pin. In other words, the reaction plate may be affixed to the rotating pin or to the rotating ARB.

As will be understood, a variety of configurations and arrangements may be used to provide the linear magnet (or eddy current) assembly 270, and the invention is not limited to a particular configuration or design for this portion of the ARB positioning system 110. Generally, the linear magnet assembly 270 is selected to provide a way or means for applying a magnetic or lifting force to the reaction plate 130 that is opposite in direction to the direction of travel of the vehicle frame or machine 104 carrying the reaction plate (e.g., in either direction of travel the magnetic or lifting force applied to the reaction plate is opposite to the movement of the vehicle). Preferably, this is achieved without providing any outside power supply or control signals (e.g., positioning occurs "automatically" in this respect based on relative motion between the vehicle carrying the ARB positioning assembly 110 and any linear magnet assemblies 270). Typically, the magnets 274, 278 provided in the linear magnet assembly 270 are permanent magnets arranged to position opposite poles proximate to each other, and, in a typical arrangement, the strength of the magnets and the generated force would be equal throughout the assembly 270. However, some embodiments may provide a varying magnetic field strength such as by providing stronger permanent magnets at either end of the linear magnet array so as to more quickly cause the plate 130 to start rotating or moving translationally (as is the case in some embodiments such as that shown in FIGS. 4-6).

Figure 3:
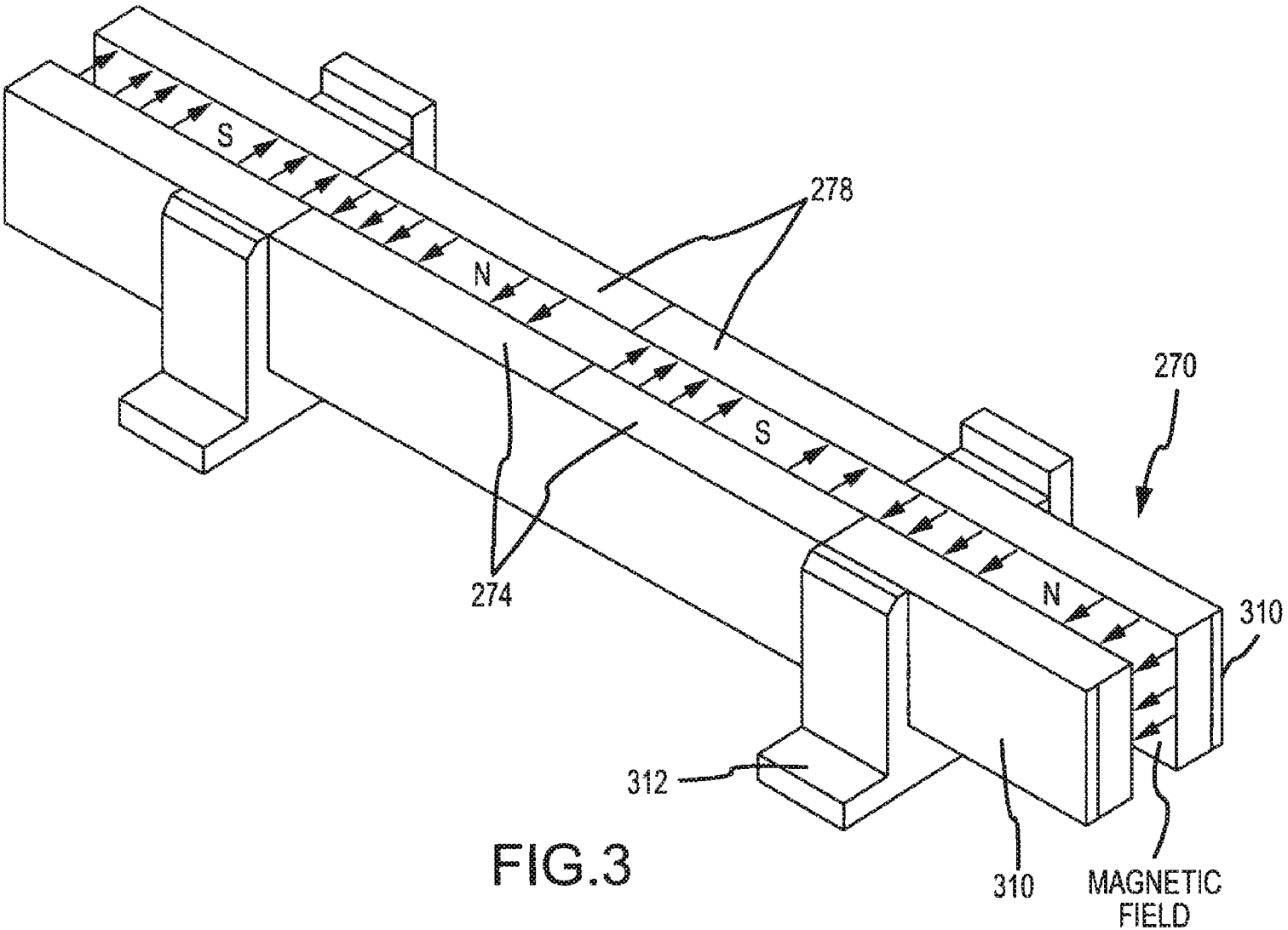
FIG. 3 illustrates one embodiment of a linear magnet (or eddy current) assembly such as may be used in the system of FIG. 2 or other implementations described herein.

FIG. 3 illustrates one embodiment of a linear magnet assembly 270 that includes a first array of magnets 274 and a second array of magnets 278 that are spaced apart to provide a slot or gap between adjacent ones or paired magnets 274, 278. The magnets 274, 278 are arranged in an alternating pattern such that pairs of adjacent magnets 274, 278 have opposite poles facing each other such that the magnets 274, 278 in each side array alternate along the length of the assembly 270 and its gap or slot, which is defined to be somewhat wider than the thickness of the plate 130 to allow the plate 130 to pass through without contacting the magnets 274, 278 (such as with an gap (or interferric gap) of up to about one eight to one half inch or more on either side of the plate 130). Hence, the assembly 270 may be thought of as a linear array of spaced apart permanent magnets that provide a force on an electrically conductive plate or fin 130 when such a fin/plate is moved through the array.

As shown, the linear magnet assembly has two magnet carriers 312 that may be designed as a yoke that is used to mount the magnets 274, 278 proximate to a run of a vehicle track in an ARB portion of the track or vehicle path. Inside of the yoke arms 312, the magnet arrangement of magnets 274, 278 provides a pair of spaced apart rails. Each rail is made of several magnet elements 274, 278, which are placed in a row one behind the other. The elements 274, 278 may be formed as or from strong permanent magnets made of a suitable material such as, but not limited to, NdFeB (neodymium, iron, and boron or the like). The magnet elements 274, 278 may be mounted on a continuous magnetically conductive metallic carrying rail 310 that may be designed as an iron back or it may also be made out of a different suitable material.

FIG. 3 illustrates the two rail-like magnet arrangements 274, 278 in a parallel orientation that may have a length that is chosen to match (or exceed) the length of an ARB portion of the track (such as to provide the linear magnet assembly 270 wherever lift/ARB pins are provided or for some length exceeding such a track section to position the ARB body in the up/suspended or down/engaging position prior to entering the ARB portion). The magnet elements 274, 278 are placed along the carrying rail 310 one behind the other, and the gap between the magnets 274 and/or 278 along the array may be filled with a non-magnetic intermediary (not shown). According to FIG. 3, the polarity of the magnet elements 274, 278 are reversed along the direction of the carrying rail 310. Accordingly, magnet elements 274 that are placed one behind the other have a different polarity. A difference of polarity also exists between the magnet elements 278 located on the opposing rails 310.

The magnetic flux is running through this polarity between the two magnetic rails crosswise through an electrically conductive, reaction plate 130 on a passing vehicle or frame 104. The reaction plate may be formed in a variety of ways to provide an electrically conductive element. For example, the plate may be formed of a plate of a single conductive material such as copper, aluminum, a steel (such as stainless steel), or the like while in other cases the plate may be formed so as to provide a vertically orientated coating carrier in the form of a planar plate or fin (e.g., with a conductive coating made of an electrical conductive material such as a layer of copper, aluminum, stainless steel, or the like that can be formed on both sides of the plate or fin 130). Between the sides or surfaces of the conductive plate 130 and both sides encompassing magnet arrangements 274, 278 exists an interferric gap.

During operation of the system 100 and its linear magnet assembly 270, the frame 104 (such as may be part of a passenger vehicle in a ride)may pass over the ARB portion as shown in FIG. 2 such that the fin/plate end 132 passes through the array or linear magnet assembly 270. The movement of the frame 104 relative to the track 108 (or, more accurately, the plate 130 relative to the magnets 274, 278) induces eddy currents that create a magnetic brake force 280. The brake forces 280 depend on different parameters like vehicle speed ($V_{car}$), the alternating frequency, magnetic force provided by magnets 274, 278, electrical conductivity of the plate 130, thickness of the plate 130 (and any layers of material provided therein), the width of the interferric gap or spacing between the sides/surfaces of the plate 130 and the adjacent magnets 274, 278, and other parameters. The brake force 280 can be influenced by changing and combining any of the listed parameters or others known to those skilled in the art to obtain desired rotation or translational movement of a reaction plate such as fin/plate 130 so as to position the ARB body in an up or suspended position or a down/engaging position.

The generation of an eddy current assembly and generating braking or lift forces to move a reaction plate may be performed in any of a number of ways that will be apparent to those skilled in the art. For example, the techniques for providing a linear magnet assembly shown in U.S. Pat. No. 6,062,350 to Spieldiener may be used and this patent is incorporated herein in its entirety by reference. Similarly, a linear magnet assembly may be provided as shown in U.S. Pat. Nos. 6,293,376; 6,523,650; and 6,659,237 all to Pribonic so as to generate the lifting/braking forces used within an ARB positioning assembly, and these patents are also incorporated herein in their entirety by reference. Linear synchronous motor techniques may also be used to provide the braking/lifting forces (e.g., to provide the linear magnet assembly 270), and techniques such as those taught in U.S. Pat. No. 6,930,413 to Marzano, which is incorporated herein in its entirety by reference, may be used to fabricate or provide an ARB positioning assembly.

FIGS. 1 and 2 show an ARB assembly 110 with a positioning device or assembly 120 that makes use of rotational movement of the reaction plate 130 to position (in this case, rotate) the ARB body 122 so as to place the engaging portion or pawl end 126 in either a down or lowered position or an up or suspended position. The lowering/actuating mechanism or means may be provided in numerous other ways. For example, the assembly 120 may be modified such that there is a differing mechanical or other linkage between the plate 130 and the ARB body 122 such that the ARB body 122 does not necessarily rotate in a one-to-one relationship with the plate 130 (e.g., with gearing that causes the ARB body 122 to rotate more or less than the plate 130 as may be useful in a particular application).

Hence, the broader concept shown herein is that a linear magnet assembly is utilized to position an ARB body or simply an ARB through a linked or connected reaction plate or fin, and such positioning is performed in an automated manner even at high speeds of a vehicle carrying the ARB assembly. Coaxially connection for rotation via a single rod or pivot pin is useful in some cases (as shown) but is not required as those skilled in the arts will readily envision numerous other connection means to cause the ARB to rotate with the reaction plate or fin.

Figure 5:
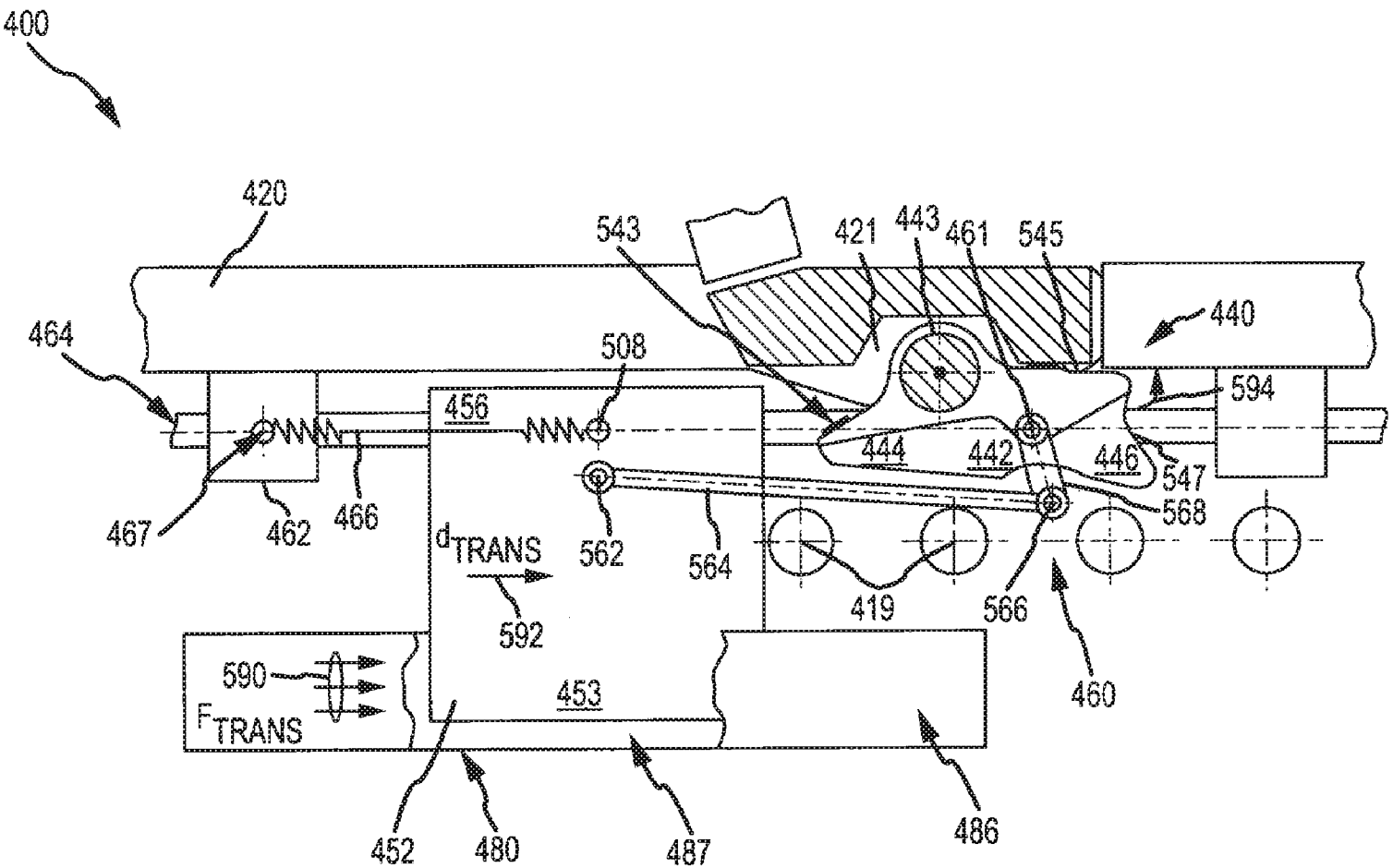
FIG. 5 illustrates a partial side view of the system of FIG. 4 showing the ARB assembly being used to rotate or lift the pawl end of the ARB body into a suspended or up position in which contact is avoided with lift/ARB pins as the vehicle passes over the ARB portion of the track.
Figure 6:
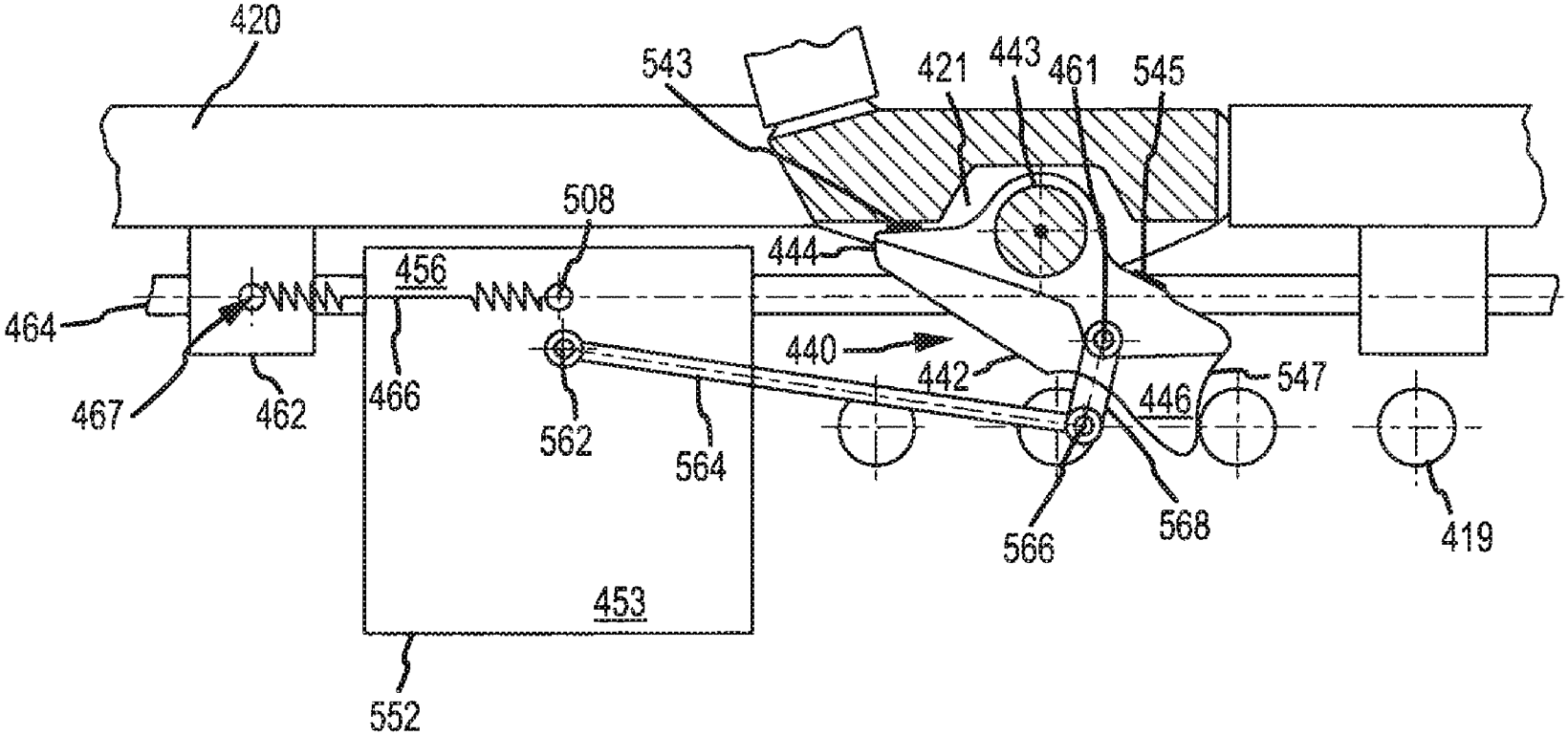
FIG. 6 shows a partial side view of the system of FIG. 4 after the vehicle has passed left or passed the ARB portion of the track (and the linear magnet assembly) illustrating the action of the spring member(s) to rotate the ARB body (or pawl end) downward into a down or engaged position with the ARB body contacting a lift/ARB pin.

In another example, the reaction plate is not rotated but is instead displaced along a linear path and its translational motion/displacement is used to position or move an ARB body through a linkage assembly. One embodiment of a tracked vehicle system 400 is shown in FIGS. 4-6 that utilizes such translational motion (versus rotational motion) of a reaction plate 452 to selectively position an ARB body 442 relative to lift/ARB pins or stops 419.

Figure 4:
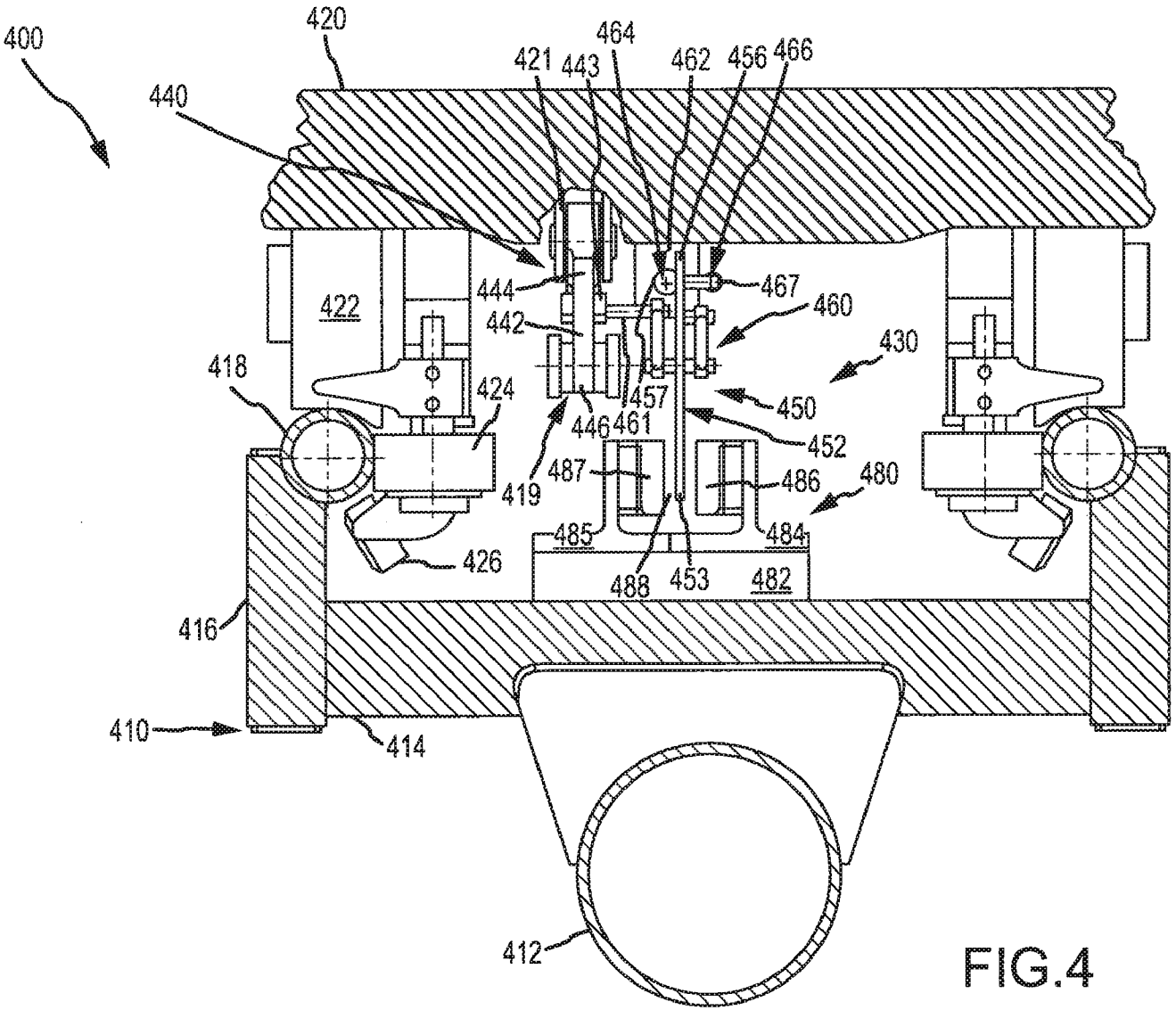
FIG. 4 is a sectional end view of a tracked vehicle system of another embodiment of the invention showing use of a brake or reaction plate to provide translational motion in response to forces created by the relative motion of the plate through a linear magnet assembly, with the translational motion being used to rotate or position an ARB body in an up or down position (with the ARB body shown in the down or engaged position in this example)

In FIG. 4, a vehicle frame/chassis 420 is shown with a partial sectional view to illustrate an ARB assembly 430 and its use to lift the frame 420 or to prevent its backward roll (or movement in an undesired direction such as into the page rather than out of the page of FIG. 4 in this example). The vehicle frame 420 may be part of an amusement/theme park ride, e.g., as a passenger vehicle in a coaster ride or the like. The vehicle may ride along a path defined by a track assembly 410 with inclines or other areas where it is desirable to include an ARB portion with ARB pins or stops 419 (or an ARB rack or the like) that can engage the ARB assembly 430. The track assembly 410 includes side tracks or rail components 416, 418 supported by ride structure members 412, 414. To allow the vehicle to roll along the track assembly 410, the frame 420 may include load wheels 422, side guide wheels 424, and up stop wheels 426 (or another wheel/roller arrangement).

The tracked vehicle system 400 includes an embodiment of an ARB assembly 430 that is adapted to use translation or linear movement of a reaction plate 452 to rotate and/or position an ARB body 442 relative to the pins 419. To this end, the ARB assembly 430 includes an ARB positioning assembly 450 and a linear magnet assembly (or eddy current assembly) 480. The ARB positioning assembly 450 is affixed or hung from the frame 420 using supports 421, 462 and is generally centered on the frame 420 (although this is not required in all applications). The ARB positioning assembly 450 includes an ARB or ARB element 440 with an ARB body 442 that is pivotally mounted to or supported upon pivot pin 443 (with the pin 443 typically being fixed or stationary in the assembly 450 and the body 442 provided on a bearing or bearing surfaces to move freely relative to the pin 443). The ARB body 442 has a first or leading end 444 and a second or pawl end 446, and the ARB positioning assembly 450 is shown in FIG. 4 to be in a down or engaged position in which the first/leading end 444 is in abutting contact with the frame 420 or support 421 and in which the second/pawl end 446 is abutting the ARB pin 419, such that vehicle frame 420 cannot roll backwards (or can be lifted by movement of the ARB pins/rack 419). In other words, the plate 452 has not yet traveled into the gap 488 in the linear magnet assembly 480 (see, also, FIG. 6 for such an arrangement).

The ARB positioning assembly 450 further includes a reaction plate 452 formed at least partially of electrically conductive material such as aluminum, a copper or copper alloy, or the like. The plate 452 is hung on or supported by a slide bar 464 with collar 457, and the plate 452 is able to slide along the bar 464 or to be linearly displaced in response to magnetic fields produced by linear magnet assembly 480. The ARB positioning assembly 450 includes a linkage or connecting assembly 460 that functions to translate linear movement of the plate 452 along the slide bar 464 into rotational movement/displacement of the ARB body 442. In this regard, FIG. 4 shows a link or linkage pin 461 connecting the reaction plate 452 to the ARB body 442.

To return the plate 452 to a neutral or normal operation position when the plate 452 is not affected by the linear magnet assembly 480 (e.g., when the vehicle associated with frame 420 leaves an ARB portion of the track 410), a resilient member or spring 466 may be used and affixed at one end to a pin/rod 467 attached to the plate 452 and at another end to the frame support 462. During operation, the spring 466 would be in (or nearer) at rest or coiled configuration in the down/lowered position of the ARB position assembly 450 shown in FIG. 4 such that it will later resist the lift/positioning force generated by the interaction between the plate 452 and the linear magnet assembly 480 when the frame 420 is moved over the linear magnet assembly 480 (as this causes the spring 466 to be stretched or uncoiled). When the plate 452 is no longer moving in the gap 488 of the magnet assembly 480, the spring 466 applies a force on the plate 452 via pin 467 as it returns to its at rest configuration, which causes the plate 452 to slide on bar 464 to its neutral or normal operating position (shown more clearly in FIG. 6).

The ARB assembly 430 includes a linear magnet assembly 480 (which may be configured as shown for assembly 270 of FIG. 3) to provide a magnetic field in a gap 488. During use of system 400, a lower end 453 of the electrically conductive reaction plate 452 passes through this gap 488 generating an eddy current in the plate 452 and moving the plate 452 along the slide bar 464 in a direction opposite the travel direction of the frame 420 on track assembly 410. Linkages 460 attached to a second or upper end 456 of the plate 452 are used to translate this linear movement of the plate 452 into rotational movement of the ARB body 442.

The linear magnet assembly 480 is supported via platform 482 on the track structural member 414 so as to extend along or parallel to the side rails or tracks 416. The linear magnet assembly 480 includes magnet supports 484, 485 that support and position a plurality of permanent magnets 486, 487 in a spaced apart manner to provide gap 488. The permanent magnets 486, 487 may be arranged as shown in FIG. 3 to generate an eddy current in the reaction plate 452 when the plate travels at or above a minimum speed/velocity through the gap (or relative to the magnets 486, 487). As discussed with reference to FIG. 3, the magnets 486, 487 may take a variety of forms to practice the invention but typically are selected to be permanent magnets such that no external power is required to operate the ARB assembly 430. For example, but not as a limitation, the magnets 486, 487 may be rare earth magnets (e.g., neodymium magnets or the like) that are encased (such as in an epoxy or the like) and then further may be housed in a non-magnetic outer housing (such as a case or house of stainless steel or the like).

FIG. 5 is a partial view of the tracked vehicle system 400 showing the ARB assembly 430 in an up or suspended position. In other words, the system 400 has been operated between FIGS. 4 and 5 such that the vehicle frame 420 has moved at a rate above a minimum velocity over the linear magnet assembly 480. As a result of this movement, the lower end 453 of the reaction plate 452 is moving in the gap 488 between the near side magnets 486 and the far magnets 487 of the linear magnet assembly 480. This results in a lifting or translation force 590 being generate and applied to the plate 452 in a direction opposite to the direction of travel of the vehicle (or frame 420) relative to the ride track (e.g., towards the left in FIG. 5).

The force 590 causes the plate or fin 452 to be displaced 592 a distance, $d_{Trans}$, opposite the direction of travel, and the plate 452 slides linearly along the slide bar 464 toward the ARB 440. Generally, the plate 452 is held in the neutral or down position of the ARB assembly 430 by the spring 466 that is attached at a first end to anchor pin 467 on frame structure element 462 and at a second end to anchor pin 508 connected to the upper end 456 of plate 452. In FIG. 5, the spring force of the spring 466 has been overcome by the magnetically generated translation force 590 to stretch the spring 466 and allow the plate 452 to be displaced as shown by arrow 592.

The movement 592 of the plate 452, in turn, causes actuation of the linkage 460 to position the ARB 440 into the up or suspended position. The linkage 460 includes pins 562 (one on each side of the plate 452 for stability) to provide an anchor point to the upper end 456 of plate 452. A pair of arms or links 564 is pivotally attached to the pins 562 and is pivotally linked at a second end to link or arm 568, which in turn is connected to pin or rod 461 that is pivotally attached to the ARB body 442. The linkage or connection assembly 460, thereby, acts to translate the linear movement 592 of the plate or fin 452 along the slide bar 464 into a rotational movement 594 of the ARB body 442.

As shown, this movement 594 causes the trailing or pawl end 446 of the ARB body 442 to rotate upward toward the vehicle frame 420 such that the receiving or engaging surface 547 of the ARB 440 is spaced apart from the lift/ARB pins 419. The positioning movement 594 is stopped or limited, in this example, by the bump stop 545 contacting the mounting or support portion 421 of the vehicle frame 420. The opposite or leading edge bump stop 543 is concurrently moved away from the support portion 421 of the frame 420 as the leading or first end 444 of the ARB body 442 rotates away from the frame 420. As with the assemblies shown in FIGS. 1 and 2, the linkage or connection assembly 460 may be configured such that the amount of movement, $d_{Trans}$, of the plate or fin 452 is multiplied (or lessened), such that a small amount of movement of the plate 452 may be used to obtain a faster or greater amount of rotation of the ARB body 442. The particular configuration of the linkage or connection assembly 460 may be varied significantly to practice the invention, and, in general, it is only important that movement (here linear) of the plate or fin 452 be translated into movement of the ARB body 442 to properly (or desirably) position the pawl end 446 relative to the ARB pins or stops 419.

Once the force 590 is removed (e.g., when the frame 420 or vehicle travels past the ARB portion of the track with the linear magnet assembly 480 such that the ARB is clear of the magnetic zone), the ARB positioning assembly 450 acts to position the ARB 440 into a down or normal operating position. This down or normal operating position is one in which the ARB 440 may engage ARB pins 419, which is shown in FIG. 6. In FIG. 6, the linear magnet assembly 480 is not shown but typically it would be provided in all sections of track where the pins 419 are provided so as to lift the ARB 440 away from the pins 419 when the vehicle is traveling rapidly (or above a minimum speed) in a desired (e.g., forward) direction. In other words, the movement of the plate 452 into the down or normal operating position may be caused or assisted by the linear magnet assembly applying a force opposite to the direction of travel (e.g., move the plate 452 to the left as shown in FIGS. 5 and 6 when the vehicle frame 420 is moved to the right), but this may not be necessary as the spring force may be adequate to move the plate.

Specifically, as shown in FIG. 6, the plate 452 has been pulled or linearly displaced by the spring or resilient member 466 as the spring 466 is allowed to return to its at rest or neutral/coiled configuration. The plate 452 is slid along the slide bar 464 away from (or more distally positioned relative to) the ARB 440. As a result, the linkage 460 acts to pull downward on the trailing or pawl end 446 of the ARB body 442 (e.g., the body 442 rotates/pivots on the pivot pin 443), and this causes the bump stop 543 of the leading end 444 to contact or abut the frame 420 near or at the support portion 421. In some portions of the track of system 400, this would occur when the vehicle moves out of or past an ARB segment and beyond the ARB pins. In FIG. 6, however, the down or normal operating position of the ARB 440 is shown to cause the pawl end 446 to be pivoted or positioned so as to engage an ARB pin 419 with surface 547. With the ARB 440 engaging the pin 419, the frame 420 could be lifted up an incline or otherwise moved by movement of the pins 419 and/or is prevented from travel in an undesired direction such as rolling backwards down an incline (or to the right in FIG. 6).

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention. While the ARB body is typically formed of a material selected mostly to be wear resistant and for its strength properties, some embodiments may be provided that eliminate a separate reaction plate/fin but instead configure the ARB body so as to be or provide an integral reaction plate or reaction surfaces.

We claim:

1. An anti-roll back (ARB) assembly for use with vehicles that ride on a track including an ARB portion adapted with a plurality of ARB pins, comprising:

a linear magnet assembly positioned along the track in the ARB portion, the linear magnet assembly comprising a pair of magnet arrays spaced apart to define a slot extending the length of the linear magnet assembly;

an ARB element having a body pivotally supported on a frame of one of the vehicles;

an electrically conductive reaction plate supported on the frame of the vehicle and positioned such that the reaction plate passes through the slot when the vehicle travels on the track over the ARB portion, wherein the reaction plate is connected to the ARB element and the ARB body pivots in response to movement of the reaction plate to position the ARB body relative to the frame of the vehicle;

a slide bar supporting the reaction plate on the vehicle; and a linkage assembly connecting the reaction late to the ARB body, wherein the movement of the reaction plate in response to magnetic forces in the slot is a linear movement along the slide bar and wherein the linkage assembly translate the linear movement of the reaction plate into a rotational displacement of the ARB body.

2. The assembly of claim 1, wherein when the vehicle travels over the ARB portion in a first direction a force is applied to the reaction plate in a second direction opposite the first direction.

3. The assembly of claim 2, wherein when the vehicle travels at a velocity exceeding a minimum speed in the first direction the force has a magnitude great enough to displace the reaction plate a predefined amount causing the ARB body to pivot into a suspended position in which the ARB body is spaced apart from the ARB pins.

4. The assembly of claim 2, wherein when the vehicle is spaced apart from the linear magnet assembly and when the vehicle travels in the second direction the ARB body is rotated downward to be positioned in a down position in which the ARB body can engage the ARB pins.

5. The assembly of claim 2, wherein when the one of the vehicles supporting the ARB element travels at a velocity less than a minimum speed in the first direction the ARB body pivots into a lowered position or is maintained in the lowered position.

6. The assembly of claim 1, further comprising a pivot pin supported on a frame of the vehicle, wherein the ARB body is rigidly attached to the pivot pin.

7. The assembly of claim 1, further comprising a resilient return member attached to the reaction plate and to the vehicle, wherein the resilient return member applies a force upon the reaction plate to position the reaction plate in a first position and the linear magnet assembly applies generates magnetic fields that apply a force upon the reaction plate to position the reaction plate in a second position distal to the first position and wherein the linkage assembly is configured to position the ARB body into a down position when the reaction plate is in the first position and into a suspended position when the reaction plate is in the second position.

8. The assembly of claim 1, wherein the reaction plate has a ratio of volume to area of between about 0.35 and about 0.5.

9. An anti-roll back assembly, comprising:

an anti-roll back (ARB) member including a body with a first end and a second end with an ARB pin receiving surface, wherein the ARB body is pivotally mounted to a frame of a vehicle;

a fin with a planar body formed at least partially of electrically conductive material, wherein the fin extends outward from the vehicle frame and is linked to the ARB body, whereby the ARB body is pivoted between a first position with the first end abutting the vehicle frame and a second position with the second end abutting the vehicle frame in response to displacement of the fin;

an eddy current assembly positioned along a length of track for the vehicle, wherein the eddy current assembly includes a gap provided between linear arrays of permanent magnets for receiving the fin when the vehicle travels over the length of the track, a slide bar supporting the fin on the vehicle; and a linkage assembly connecting the fin to the ARB body, wherein the movement of the fin in response to magnetic forces in the slot is a linear movement along the slide bar wherein the linkage assembly translate the linear movement of the fin into a rotational displacement of the ARB body.

10. The assembly of claim 9, wherein a plurality of ARB pins are provided along the length of the track and wherein the ARB body engages at least one of the ARB pins with the second end when pivoted into the first position and the second end of the ARB body is spaced apart from adjacent ones of the ARB pins when the ARB body is pivoted into the second position.

11. The assembly of claim 9, wherein the permanent magnets are arranged within the arrays to generate a magnetic zone in the gap that creates an eddy current in the fin body when the fin passes through the gap at a velocity exceeding a predefined minimum velocity and wherein, in response, a force is applied to the fin body in a direction opposite to a direction of travel of the fin body, whereby the fin is displaced to move the connected ARB body to the first position or to the second position.

12. The assembly of claim 9, wherein the displacement of the fin body is a linear displacement and wherein the fin body is connected to the ARB body via the linkage assembly that translates the linear displacement of the fin body to a rotational displacement of the ARB body between the first and second positions.

13. The assembly of claim 9, further comprising a resilient return member connecting the fin to the vehicle frame that applies a force on the fin to be displaced to urge the ARB body toward the first position.

14. The assembly of claim 9, wherein the fin has a ratio of volume to area of between about 0.35 and about 0.5.

15. An amusement park ride, comprising:

a vehicle track with an inclined portion including a plurality of stops;

a vehicle adapted for traveling on the vehicle track and including a structural portion adjacent the vehicle track;

an anti-roll back pawl pivotally attached to the structural portion of the vehicle;

a reaction blade protruding outward from the structural portion of the vehicle, the reaction blade having a planar body formed at least partially from electrically conductive material, wherein the reaction blade is linked to the anti-roll back pawl;

positioned along the inclined portion of the vehicle track, a linear magnet assembly comprising two spaced apart, linear arrays of permanent magnets defining an elongated gap between the arrays, wherein the reaction blade extends into the gap between the arrays when the vehicle travels over the inclined portion;

a slide bar supporting the reaction blade on the vehicle; and a linkage assembly connecting the reaction blade to the ARB body, wherein the movement of the reaction blade in response to magnetic forces in the gap is a linear movement along the slide bar and wherein the linkage assembly translate the linear movement of the reaction blade into a rotational displacement of the ARB body.

16. The ride of claim 15, wherein a force is imparted upon the reaction blade when the vehicle travels over the inclined portion and wherein the force is opposite in direction to a direction of travel of the vehicle.

17. The ride of claim 15, wherein the anti-roll back pawl is positionable in a first position in which the anti-roll back pawl contacts the stops when the vehicle travels over the inclined portion and is positionable in a second position in which the anti-roll back pawl is spaced apart from proximal ones of the stops.

18. The ride of claim 17, wherein when the vehicle travels over the inclined portion a force is applied on the reaction blade causing a magnitude of displacement and wherein the reaction blade is linked to the anti-roll back pawl to translate the displacement of the reaction blade into a movement of the anti-roll back pawl from the first to the second position or from the second to the first position.

19. The ride of claim 18, wherein the displacement is a linear displacement that is translated via a linkage assembly to the movement of the anti-roll back pawl that is rotational about a pivot pin attaching the anti-roll back pawl to the structural portion of the vehicle.

20. The ride of claim 15, wherein the planar body of the reaction blade protrudes downward from the vehicle further than the anti-roll back pawl.

* * * * *

UNITED STATES PATENT AND TRADEMARK OFFICE

CERTIFICATE OF CORRECTION

PATENT NO. : 8,020,494 B2
APPLICATION NO. : 12/622777
DATED : September 20, 2011
INVENTOR(S) : Smith et al.

It is certified that error appears in the above-identified patent and that said Letters Patent is hereby corrected as shown below:

Column 13, line 20, delete “late” and insert therefor --plate--.

Signed and Sealed this
First Day of November, 2011

David J. Kappos

David J. Kappos
*Director of the United States Patent and Trademark Office*